United States Patent [19]

Kern

[11] 4,381,218

[45] Apr. 26, 1983

[54] APPARATUS FOR TESTING COMBUSTIBILITY OF WOOD PULP BLOW GASES

[75] Inventor: Nicholas T. Kern, Covington, Va.

[73] Assignee: Westvaco Corporation, New York, N.Y.

[21] Appl. No.: 32,023

[22] Filed: Apr. 20, 1979

[51] Int. Cl.[3] ..... D21C 7/16; D21C 11/08; G01L 23/08

[52] U.S. Cl. ..... 162/252; 162/263; 73/35

[58] Field of Search ..... 162/49, DIG. 10, 198, 162/15, 47, 263, 252, 51, 238; 73/35, 432 SD

[56] References Cited

U.S. PATENT DOCUMENTS

| | | | |
|---|---|---|---|
| 263,939 | 9/1882 | Monnier | 73/35 |
| 2,917,927 | 12/1959 | Clark | 73/35 |
| 2,937,530 | 5/1960 | Haley | 73/35 |
| 3,183,145 | 5/1965 | Collins, Jr. | 162/47 |
| 3,520,772 | 7/1970 | Lindberg | 162/51 |
| 3,526,124 | 9/1970 | Wostl | 73/35 |
| 3,545,252 | 12/1970 | Springfield et al. | 73/432 SD |
| 3,978,877 | 9/1976 | Cox | 73/35 |
| 4,140,004 | 2/1979 | Smith et al. | 73/35 |

OTHER PUBLICATIONS

Smith et al., "An Industry Update: State-of-the-art in on-line sensors for energy systems"; Paper Trade Journal; 1-30-79, pp. 38-46.

"Collection and Treatment of Odorous Kraft Mill Gases"; Rushton Paper Trade Journal pp. 36-37, 12-1-8-72.

*Primary Examiner*—Steve Alvo

*Attorney, Agent, or Firm*—W. A. Marcontell; R. L. Schmalz

[57] ABSTRACT

The flammability of non-condensible blow gases from a wood pulping digester is continuously monitored by venting a low volume sample flow stream of such gases through a small combustion chamber where the stream is subjected to an intermittent ignition source. Unusually high pressures in the combustion chamber resulting from ignition of a flammable mixture are detected by pressure measuring means providing the operative result of automatically venting a dangerous flow increment of the gas.

2 Claims, 1 Drawing Figure

APPARATUS FOR TESTING COMBUSTIBILITY OF WOOD PULP BLOW GASES

BACKGROUND OF THE INVENTION

1. Field of the Invention

The present invention relates to safety monitors and appliances for a wood pulping mill environmental control system. More particularly, the present invention relates to the method of and apparatus for monitoring the combustibility of non-condensible digester blow gas.

2. Description of the Prior Art

The kraft process of delignifying wood chips for the purpose of cellulose fiber liberation releases small quantities of highly volatile turpentine and mercaptan compounds in the form of substantially non-condensible vapors. Although the quantity of such gases produced by the process is extremely small in relation to the useable mass of the wood, nevertheless, such compounds are substantially responsible for the characteristic odor generally associated with pulp mills.

In the interest of reducing this environmental irritation, pulp mills have, in recent years, eliminated the atmospheric venting of all digester blow gases. According to the best of practice, these gases are isolated from the liquid and solid constituents of a digester discharge at the blow tank to be processed separately to, first, recover steam heat value and, secondly, strip the water soluble compounds.

Those gases remaining in the vapor stream following condensation and water stripping are, substantially, the volatile, odoriferous compounds first described. Due to the combustibility thereof, these gases are burned in the firebox of a convenient heating appliance such as a lime kiln or recovery furnace. It is in the final transport of these isolated flammables that significant hazards arise.

Ideally, such gases should be volumetrically concentrated under increased pressure and delivered to the heating appliance in a controlled manner as a fuel. However, the absolute quantity and specific heating value thereof is normally insufficient to justify the capital cost of compressors and accessory equipment required. Nevertheless, the total vapor pressure of the gas must be sufficient to permit a flow transfer into a normally negative pressure firebox. This circumstance is resolved by discharging the odor control draft induction fan required by the non-condensible gas stream stripper unit directly into the suction flow of the heating appliance primary draft fan. However, the odor control fan includes a fresh air source on the draft side thereof which mixes with the noncondensible gas flow stream. Normally, the resulting mixture is too fuel-lean to be combustible. It is only when the noncondensible gas stream is particularly rich that a combustible mixture may be created which fills the duct work between the fresh draft air confluence and the non-condensible gas stream. If this combustible mixture is subjected to a convenient ignition source, considerable equipment destruction will occur.

Although numerous electrolytic sensory devices are available to continuously measure the combustibility of the critical gas flow stream, long term reliability of such devices in the corrosive atmosphere of a pulp mill is less than satisfactory.

It is the object of the present invention, therefore, to teach a method of reliability monitoring the combustibility of blow gases prior to the firebox of a major heating appliance.

Another object of the invention is to provide fabrication details of a reliable apparatus for monitoring the combustibility of a digester flow gas disposal system.

SUMMARY OF THE INVENTION

The method and apparatus by which these and other objects of the invention are accomplished comprises a small sample flow line connected to the primary condensible gas duct between the odor control fan and the chosen heating applicance primary draft fan. This sample flow line is laid to a convenient location where it is connected to a small combustion chamber of heavy pipe section.

The combustion chamber pipe is capped at one axial end with a heavy plate section and at the other with a thin frangible disc clamped between flanges. Preferably, the frangible disc is calibrated to fail at a pressure comfortably below the failure pressure of the remaining combustion chamber structure. Through the cylindrical wall of the combustion chamber is provided a sparking electrode of the automotive type. A small gas exit flow conduit penetrates the combustion chamber wall at a location opposite the electrode from the gas sample supply line to require a sweep of the gas from entrance to exit past the electrode. Also penetrating the combustion chamber wall is a high/low pressure switch connection tube. Appropriate alarms and valve signal converters are connected to the respective pressure switch terminals.

In operation, a sample flow of the potentially hazardous gas is induced by the odor control fan discharge pressure. Such sample flow sweeps past the sparking electrode in transit from the inlet and exit conduit ports. The electrode is connected to discharge intermittently on a continuous duty cycle.

Should a segment of the normally inert gas sample become combustible, an ignition will occur resulting in a pressure surge. A surge in excess of limits prescribed by the pressure switch high-limit setting actuates a signal relay system to operate appropriate valves in the primary gas stream duct and vent the dangerous flow segment away.

BRIEF DESCRIPTION OF THE DRAWING

The single FIGURE of the drawing illustrates a flow schematic of a pulp mill odoriferous gas stream having the present invention connected therewith.

DESCRIPTION OF THE PREFERRED EMBODIMENT

Figure 1:
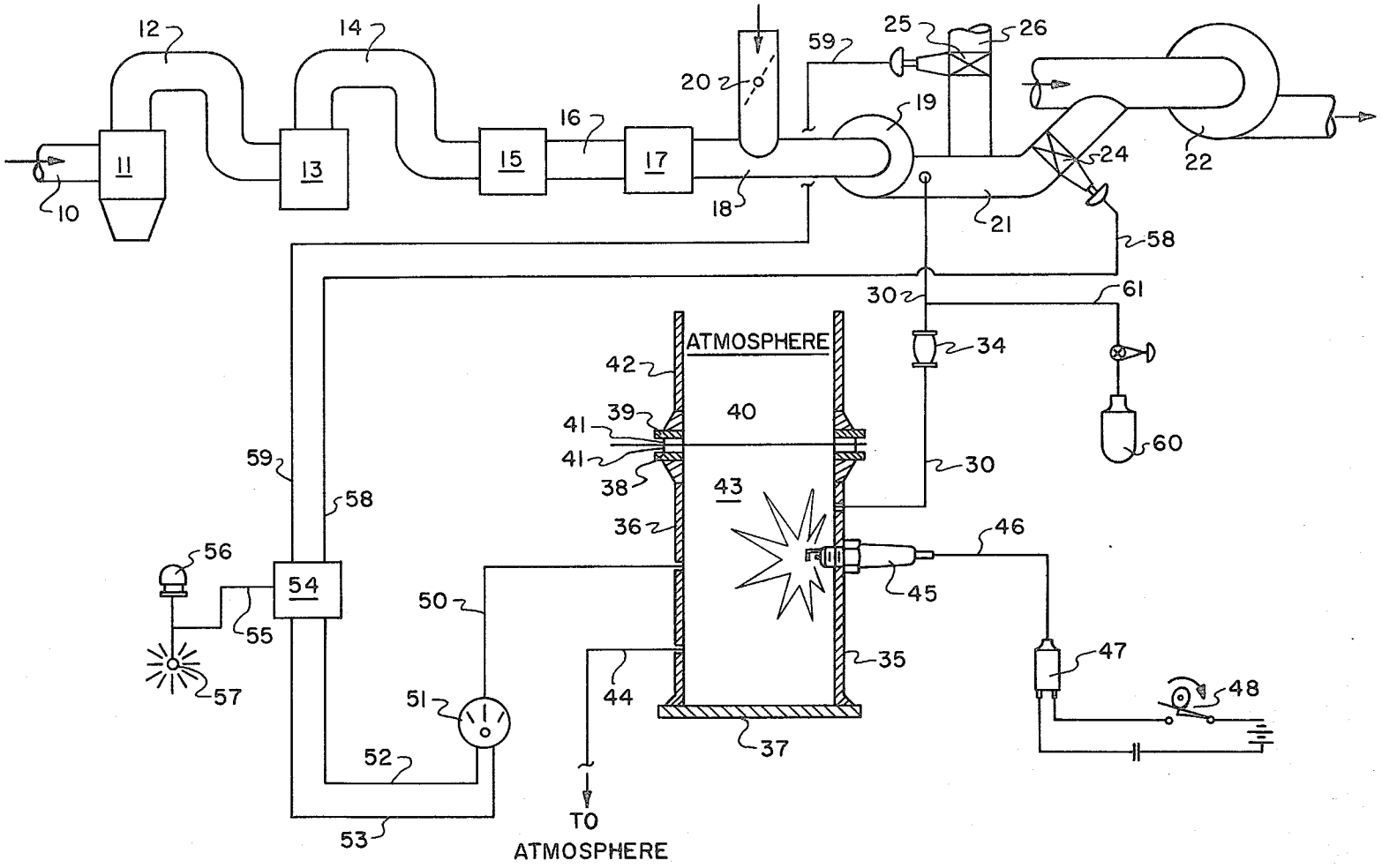

Following the relevant portion of a wood pulp flow stream, a completed pulp charge is expelled from a cooking digester, not shown, through a blow pipe 10 into an atmospheric blow tank 11 for an initial, gross separation of the solid, liquid and vaporous constituents. The gaseous portion of the digester charge is withdrawn from the top of the blow tank vessel through a large diameter pipe 12 and ducted into an accumulator vessel 13 for preservation of a major portion of the heat values present in the resulting condensate. Remaining vapors are drawn from the accumulator through pipe 14 and ducted to a condenser 15 for further heat removal and subsequently, through pipe 16, to a scrubber 17 for reactive removal of remaining particulates and water soluble compounds.

The gaseous residue from the scrubber 17, drawn through pipe 18 by the draft induction of odor control fan 19, predominately comprises an odorous, non-condensible mixture of hydrogen sulfide, methyl mercaptan, methyl disulfide and turpentine gases which, when combined with appropriate portions of oxygen, are combustible. Damper regulated draft pipe 20 normally provides sufficient dilution air to exceed the combustible mixture range for the resulting gas/air stream discharged from the odor control fan 19 through pipe 21 as auxiliary draft for a primary air supply fan 22 supporting a large heating appliance such as a lime kiln, recovery furnace, etc. not shown. Within the firebox of such a large appliance, the odorous gases are consumed harmlessly without consequence.

Under unusual circumstances, however, such as when two or more digesters are blown simultaneously, the quantity of such non-condensible gas effluent increases sufficiently to result in a combustible mixture when combined with the relatively constant influx of dilution air drawn through draft pipe 20. If ignited, this combustible mixture is capable of destroying the equipment line between the draft pipe 20 and the primary appliance fan 22, inclusive. Moreover, experience has proven that such ignition is highly probable.

According to the present invention, gas discharged from the odor control fan 19 is continuously tested for combustibility. If the test responds positively, valves 24 and 25 are operated simultaneously to close the auxiliary draft pipe 21 to the primary fan 22 and open an atmospheric vent 26 for harmlessly dumping the dangerous mixture.

The continuous test apparatus comprises a small pipe conduit 30 connected into that section 21 of the main gas stream pipe between the odor control fan 19 and the primary appliance fan 22. The small positive pressure from the odor control fan 19 discharge is sufficient to induce a gas sample flow through the conduit 30 and a test cell 35. Within the flow line 30 between pipe section 21 and the test cell 35, a flame arrester 34 is provided.

The test cell 35 comprises a cylindrical pipe section 36 of approximately 2 inches diameter and 12 inches length, for example. One axial end of the pipe section is securely sealed by a welded base portion 37. The other axial end of the pipe section 36 is provided with a flange connector 38. A cooperative flange section 39 is used to seal a thin frangible disc 40 of a stainless steel sheet between gaskets 41. Flange section 39 is preferably secured to a relief pipe section 42.

The frangible disc 40 is a commercially available piping component which is scribed or otherwise fabricated to fail under a calibrated pressure stress load. A rupture or failure pressure characteristic of the disc 40 is selected on the basis of the remaining test cell 35 enclosure structure load capacity: the failure pressure of the disc 40 being comfortably less than the failure pressure of the test cell.

The volumetric space internally of the pipe wall 36 and between the base 37 and frangible disc 40 constitutes a combustion chamber 43.

Gas flow introduced to the combustion chamber 43 by conduit 30 is normally discharged through small diameter exhaust conduit 44. Between the pipe wall 36 ports for inlet and exhaust conduits 30 and 44, respectfully, is provided a sparking electrode such as an automotive spark plug 45 energized by a conduit 46 from the secondary winding of a transformer 47. The transformer primary circuit is intermittently charged by an appropriate timed switching mechanism such as a clock driven cam switch 48. An appropriate sparking cycle may include 3 seconds of sparking in a 15 second cycle.

Also connected to the combustion chamber 43 by means of conduit 50 is a high/low pressure limit switch 51. Electrical conduits 52 and 53 connect the respective pressure switch circuits 52 and 53 to appropriate signal converting equipment shown generally and collectively by unit 54. Signal outputs from the converting unit 54 may include electrical circuits 55 for audio and visual alarms 56 and 57, respectively. Other output signals from the converting unit 54 may include pneumatic signals 58 and 59 for operating valves 24 and 25, respectively.

A useful accessory to the aforedescribed test system may include a source 60 of propane or other combustible gas having known properties for selective connection to the test sample pipe 30 by means of a valved conduit 61.

In operation, a small volumetric flow rate sample of the gas discharged from odor control fan 19 continuously flows through and fills the combustion chamber 43 where it is exposed to an intermittent ignition source 45. Normally, there will be little or no combustion response and the sample stream flows harmlessly from the chamber 43 through exhaust conduit 44.

Occasionally, however, a significant ignition of the sample flow stream may be attained to create a pressure wave sufficient to set off the high limit of pressure switch 51. Responsively, high limit signals from the pressure switch 51 are converted by unit 54 to set off alarms 56 and 57 and operate the valves 24 and 25 to atmospherically vent the main flow stream of the dangerous gas to the atmosphere.

In an extreme case, the flow sample may become sufficiently explosive to rupture the frangible disc 40. This event will harmlessly relieve otherwise distructive pressures within the chamber 43. Only the inexpensive frangible disc 40 designed for expeditious replacement will be destroyed.

The low pressure limit switch 51 serves to monitor the continued operation of the system with regard to a cessation of the sample flow stream due to plugging of the conduit 30.

Having fully described my invention obvious alternatives and mechanical equivalents will readily occur to those of ordinary skill in the art. As an invention, therefore,

I claim:

1. The combination of:

A. A wood pulping digester blow tank having means to substantially isolate vaporous constituents from the liquid and solid constituents of a blow charge of cooked wood pulp;

B. Means to substantially isolate non-condensible gases from said vaporous constituents within a primary flow stream carrier duct;

C. Means to combine said non-condensible gases with firebox draft for a heating appliance;

D. First conduit means connecting combustion chamber means with said carrier duct to continuously draw a sample flow of said gas from said primary flow stream into said combustion chamber;

E. Second conduit means for continuously venting said combustion chamber;

F. Intermittent Ignition means within said combustion chamber to ignite combustible portions of said gas;

G. Pressure responsive means connected to said combustion chamber for emitting control signals when pressures within said combustion chamber exceed a first predetermined magnitude; and, H. Means to divert said primary flow stream away from said firebox draft in response to said control signals.

2. The combination of claim 1 wherein a replaceable wall portion of said combustion chamber comprises a frangible element calibrated to rupture at a second predetermined pressure above said first predetermined pressure.

* * * * *